US006918185B2

(12) United States Patent
Barger

(10) Patent No.: US 6,918,185 B2
(45) Date of Patent: Jul. 19, 2005

(54) CHAIN SAW HANDLE EXTENSION

(76) Inventor: Samuel E. Barger, 1504 Hidden River Trail, Graham, NC (US) 27253

( * ) Notice: Subject to any disclaimer, the term of this patent is extended or adjusted under 35 U.S.C. 154(b) by 0 days.

(21) Appl. No.: 10/206,611

(22) Filed: Jul. 26, 2002

(65) Prior Publication Data

US 2004/0016130 A1 Jan. 29, 2004

Related U.S. Application Data

(60) Provisional application No. 60/314,421, filed on Aug. 23, 2001.

(51) Int. Cl.[7] ..... B27B 17/00

(52) U.S. Cl. ..... 30/296.1; 30/381

(58) Field of Search ..... 30/296.1, 298, 30/381, 382, 383, 384, 385, 386; 16/427, 436, 437

(56) References Cited

U.S. PATENT DOCUMENTS

| | | | | | |
|---|---|---|---|---|---|
| 3,731,380 | A | * | 5/1973 | Mathiesen | 30/381 |
| 3,949,817 | A | * | 4/1976 | Rice | 30/381 |
| 4,207,675 | A | * | 6/1980 | Causey et al. | 30/296.1 |
| 4,359,822 | A | * | 11/1982 | Kolodziejczyk | 30/296.1 |
| 4,658,507 | A | | 4/1987 | Hazen | |
| 4,757,613 | A | | 7/1988 | Baudreau et al. | |
| 4,805,308 | A | | 2/1989 | Ritola | |
| 4,841,641 | A | | 6/1989 | Laidlaw | |
| 4,999,917 | A | * | 3/1991 | Neville et al. | 30/296.1 |
| 5,787,536 | A | * | 8/1998 | Pate | 30/296.1 |
| 5,884,403 | A | * | 3/1999 | Rogers | 30/296.1 |
| 5,960,549 | A | | 10/1999 | Hoppner | |

* cited by examiner

*Primary Examiner*—Hwei-Siu Payer
(74) *Attorney, Agent, or Firm*—Roy, Kiesel, Keegan & DeNicola

(57) ABSTRACT

A chain saw handle extension that includes an attachment mechanism at the far ends thereof for securement to a top and a bottom of a chain saw; and a clamping structure attached to the attachment mechanism that is clampable about the bottom of an existing chain saw handle and a bottom end of the extension; the extension including a speed control trigger connectable to the control trigger of an existing chain saw that is located such that the speed control trigger of the chain saw handle extension is positioned well behind the existing trigger of the chain saw; each of the attachment structures at the end of the V-shaped structures including a threaded knob which is threadable into a threaded aperture that is provided within a body of a chain saw attached to the existing chain saw handle.

2 Claims, 3 Drawing Sheets

CHAIN SAW HANDLE EXTENSION

This application is a continuation-in-part of U.S. Provisional Patent Application No. 60/314,421 filed on Aug. 23, 2001, which is hereby incorporated by reference in its entirety.

TECHNICAL FIELD

The present invention relates to chain saw accessories and more particularly to a chain saw handle extension that includes a V-shaped handle structure including an attachment mechanism at the far ends thereof for securement to a top and a bottom of a chain saw; and a clamping structure attached to the attachment mechanism that is clampable about the bottom of an existing chain saw handle and a bottom end of the extension; the extension including a speed control trigger connectable to the control trigger of an existing chain saw that is located such that the speed control trigger of the chain saw handle extension is positioned well behind the existing trigger of the chain saw; each of the attachment structures at the end of the V-shaped structures including a threaded knob which is threadable into a threaded aperture that is provided within a body of a chain saw attached to the existing chain saw handle.

BACKGROUND ART

It is often difficult for an individual to control a chain saw because the handle provided on the chain saw does not provide the user with the leverage needed to operate the chain saw in a safe and effective manner. It would be desirable, therefore, to have an extension handle that could be attached to an existing chain saw that would provide the user with hand grips which would increase the user's mechanical advantage and ability to manipulate the chain saw.

GENERAL SUMMARY DISCUSSION OF INVENTION

It is thus an object of the invention to provide a chain saw handle extension that includes an attachment mechanism at the far ends thereof for securement to a top and a bottom of a chain saw; and a clamping structure attached to the attachment mechanism that is clampable about the bottom of an existing chain saw handle and a bottom end of the extension; the extension including a speed control trigger connectable to the control trigger of an existing chain saw that is located such that the speed control trigger of the chain saw handle extension is positioned well behind the existing trigger of the chain saw; each of the attachment structures at the end of the V-shaped structures including a threaded knob which is threadable into a threaded aperture that is provided within a body of a chain saw attached to the existing chain saw handle.

Accordingly, a chain saw handle extension is provided. The chain saw handle extension includes an attachment mechanism at the far ends thereof for securement to a top and a bottom of a chain saw; and a clamping structure attached to the attachment mechanism that is clampable about the bottom of an existing chain saw handle and a bottom end of the extension; the extension including a speed control trigger connectable to the control trigger of an existing chain saw that is located such that the speed control trigger of the chain saw handle extension is positioned well behind the existing trigger of the chain saw; each of the attachment structures at the end of the V-shaped structures including a threaded knob which is threadable into a threaded aperture that is provided within a body of a chain saw attached to the existing chain saw handle.

BRIEF DESCRIPTION OF THE DRAWINGS

For a further understanding of the nature and objects of the present invention, reference should be made to the following detailed description, taken in conjunction with the accompanying drawings, in which like elements are given the same or analogous reference numbers and wherein.

EXEMPLARY MODE FOR CARRYING OUT THE INVENTION

Figure 1:
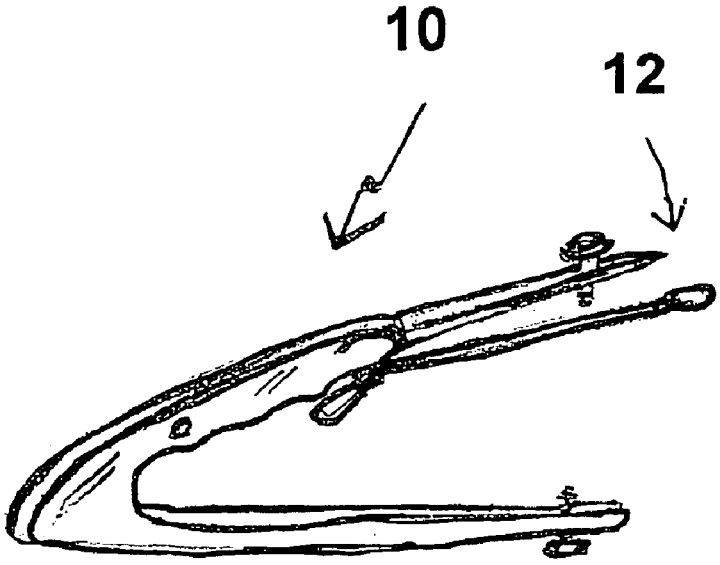
FIG. 1 is a side plan view of an exemplary embodiment of the chain saw handle extension.
Figure 2:
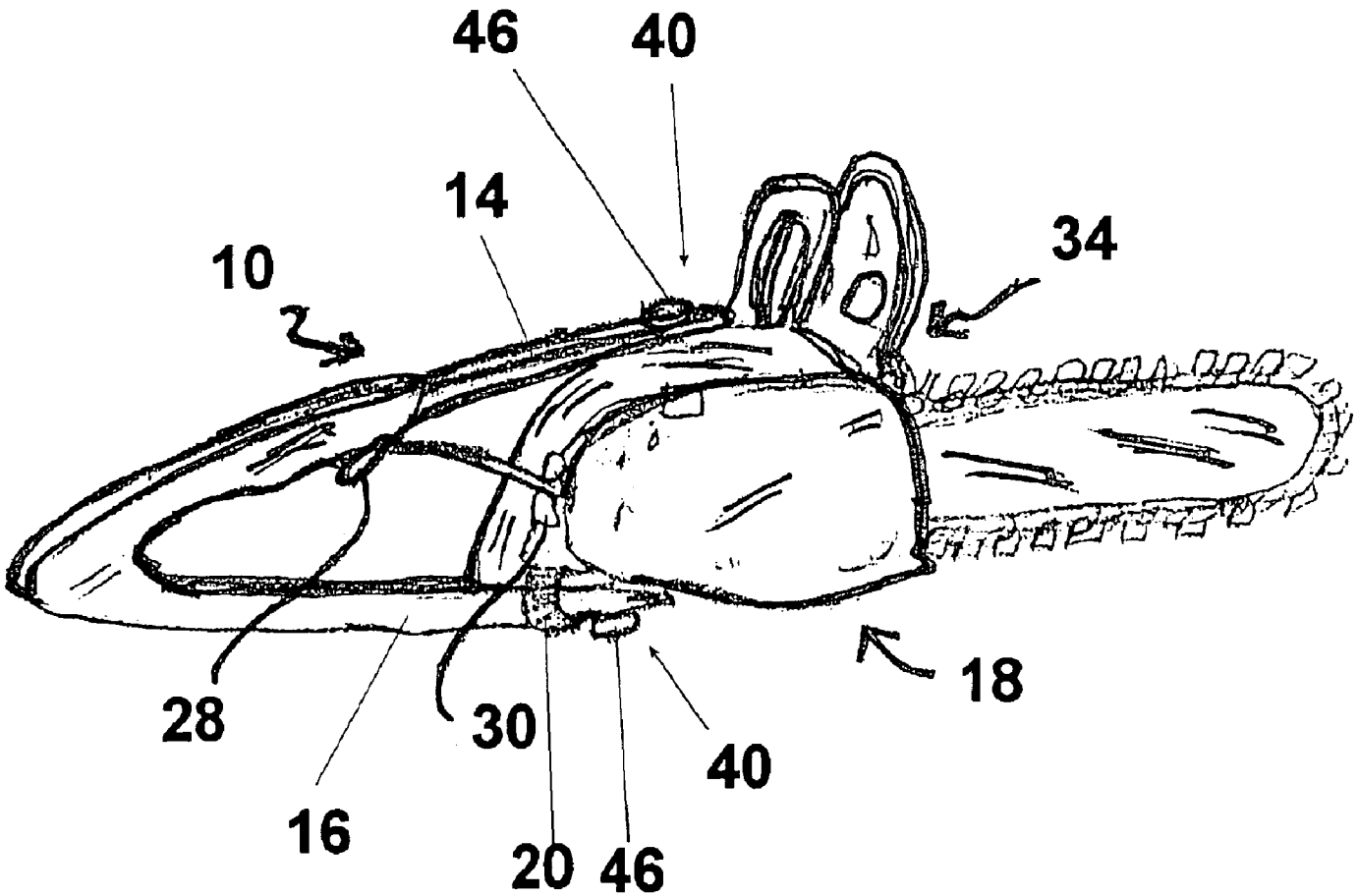
FIG. 2 shows the exemplary chain saw handle extension of FIG. 1 attached to a representative chain saw.
Figure 3:
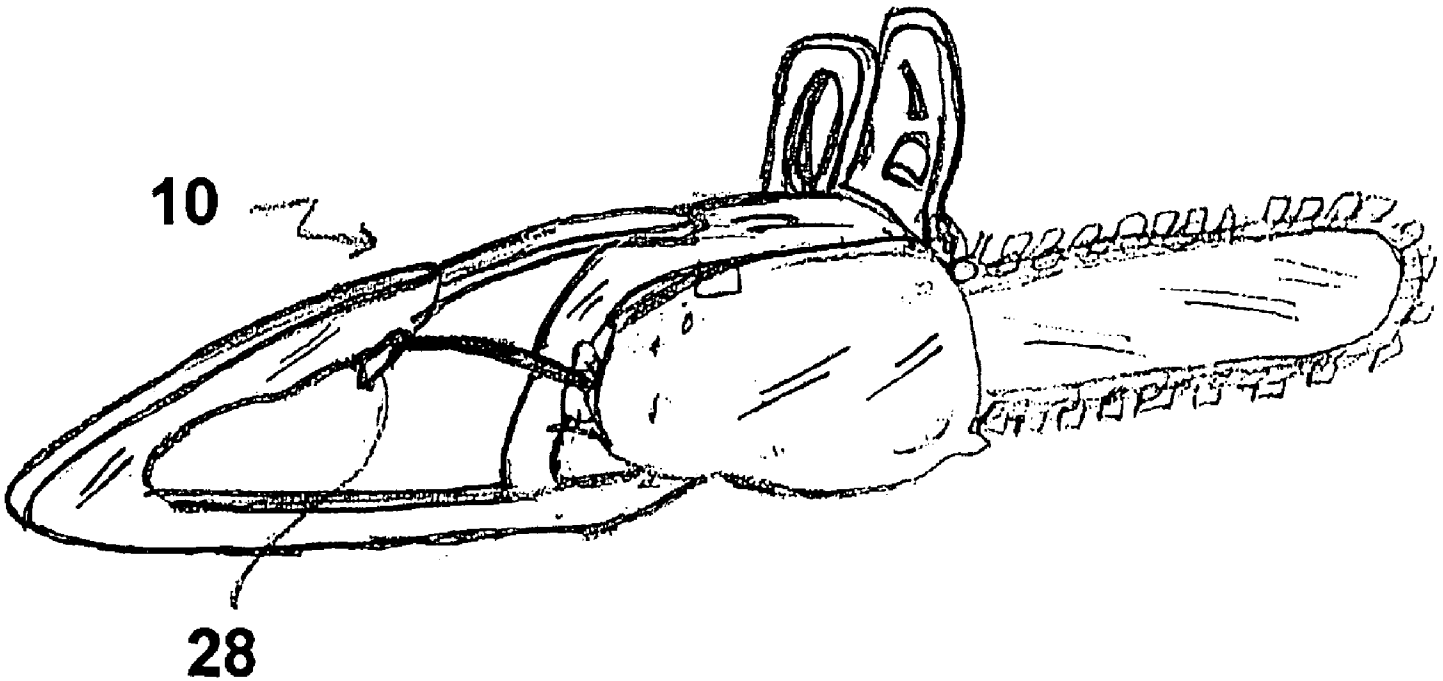
FIG. 3 shows a second exemplary embodiment with the chain saw handle extension permanently secured to a chain saw.

FIGS. 1–3 show various aspects of an exemplary embodiment of the chain saw handle extension of the present invention generally designated 10. Chain saw handle extension 10 includes a V-shaped attachment mechanism, generally designated 12, at the far end thereof that is adapted for securement to a top 14 and a bottom 16 of a chain saw handle, generally designated 18; and a clamping structure, generally designated 20, attached to the attachment mechanism 12 that is clampable about the bottom 16 of an existing chain saw handle 18 and a bottom end of the extension 10. The extension 10 including a speed control trigger, generally designated 28, connectable to the control trigger 30 of an existing chain saw 34 that is located such that the speed control trigger 28 of the chain saw handle extension 10 is positioned well behind the existing control trigger 30 of the chain saw 34. Each of the attachment structures, generally designated 40, at the end of the V-shaped structure 12 including a threaded knob 46 which is threadable into a threaded aperture 48 that is provided within a portion chain saw 34.

It can be seen from the preceding description that a chain saw handle extension has been provided.

It is noted that the embodiment of the chain saw handle extension described herein in detail for exemplary purposes is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. A chain saw handle extension comprising:

a V-shaped handle structure including an attachment mechanism at the far ends thereof for securement to a top and a bottom of a chain saw; and a clamping structure attached to the attachment mechanism that is clampable about the bottom of an existing chain saw handle and a bottom end of the extension;

the extension including a speed control trigger connectable to a control trigger of said chain saw that is located such that the speed control trigger of the chain saw handle extension is positioned well behind the said trigger of the chain saw;

each of the attachment mechanisms at the end of the V-shaped structure including a threaded knob which is threadable into a threaded aperture that is provided within a body of the chain saw attached to the existing chain saw handle.

2. A chain saw handle extension comprising:

a handle structure including an attachment mechanism at the far ends thereof for securement to a top and a bottom of a chain saw; and a structure attached to the attachment mechanism that is clampable about the bottom of an existing chain saw handle and a bottom end of the extension;

the extension including a speed control trigger connectable to a control trigger of said chain saw that is located such that the speed control trigger of the chain saw handle extension is positioned behind the said trigger of the chain saw.

* * * * *